US009457992B2

(12) United States Patent
Ooms

(10) Patent No.: US 9,457,992 B2
(45) Date of Patent: Oct. 4, 2016

(54) STAIR LIFT

(71) Applicant: Otto Ooms B.V., Bergambacht (NL)

(72) Inventor: Andre Ooms, Bergambacht (NL)

(73) Assignee: Otto Ooms B.V., Bergambacht (NL)

( * ) Notice: Subject to any disclaimer, the term of this patent is extended or adjusted under 35 U.S.C. 154(b) by 82 days.

(21) Appl. No.: 14/363,239

(22) PCT Filed: Dec. 11, 2012

(86) PCT No.: PCT/NL2012/050878
§ 371 (c)(1),
(2) Date: Jun. 5, 2014

(87) PCT Pub. No.: WO2013/095110
PCT Pub. Date: Jun. 27, 2013

(65) Prior Publication Data

US 2014/0326540 A1 Nov. 6, 2014

(30) Foreign Application Priority Data

Dec. 13, 2011 (NL) ..... 2007964

(51) Int. Cl.
*B66B 9/08* (2006.01)
*B66B 1/14* (2006.01)
(Continued)

(52) U.S. Cl.
CPC ..... *B66B 9/08* (2013.01); *B66B 1/468* (2013.01); *A61G 5/061* (2013.01); *B66B 2009/0884* (2013.01); *B66B 2009/0892* (2013.01); *B66B 2201/463* (2013.01); *B66B 2201/4669* (2013.01)

(58) Field of Classification Search
CPC ..... B66B 1/34; B66B 1/50; B66B 9/08; B66B 1/52; B66B 1/14; B66B 1/463; B66B 1/468; A61G 3/06; A61G 5/061
USPC ..... 187/200–202, 247, 380, 388, 389; 414/921
See application file for complete search history.

(56) References Cited

U.S. PATENT DOCUMENTS 5,201,377 A * 4/1993 Wilson ..... A61G 5/045 180/6.5
5,248,007 A * 9/1993 Watkins ..... A61G 5/061 180/169

(Continued)

FOREIGN PATENT DOCUMENTS

EP 2377795 B1 11/2012
GB 2463734 A * 3/2010 ..... B66B 9/08

(Continued)

*Primary Examiner* — William A Rivera
*Assistant Examiner* — Stefan Kruer
(74) *Attorney, Agent, or Firm* — Marcus C. Daves; Daniel L. Dawes

(57) ABSTRACT

A device, in particular a stair lift, for conveying a person from a first level to a second level, comprising a rail (2) which extends between the first and the second level, a frame (3) which is provided with engaging means designed to engage the rail (2) in such a manner that the frame (3) can be moved along the rail (2), driving means designed to cause the frame (3) to move along the rail (2), and a support (5), in particular a chair, on which the person can be seated, which stair lift is furthermore provided with control means designed to activate the driving means, wherein the control means comprise at least a touch-sensitive surface (9), which surface extends or may extend in such a manner that a person can rest his or her hand, or a part thereof, on the surface so as to activate the driving means.

8 Claims, 7 Drawing Sheets

(51) Int. Cl.
*A61G 5/06* (2006.01)
*B66B 1/46* (2006.01)

(56) References Cited

U.S. PATENT DOCUMENTS 7,093,693 B1 * 8/2006 Gazdzinski ..... B66B 1/468 187/384
2005/0252723 A1 * 11/2005 Takeuchi ..... B66B 1/468 187/380
2006/0225964 A1 * 10/2006 Takeuchi ..... B66B 1/463 187/247
2006/0260876 A1 * 11/2006 Woodhams ..... B66B 9/0853 187/201

FOREIGN PATENT DOCUMENTS

JP 2008100788 5/2008
KR 101020722 3/2011
NL WO 9615974 A1 * 5/1996 ..... B66B 9/0838
WO WO-2006101316 9/2006
WO WO-2008074967 6/2008

* cited by examiner

STAIR LIFT

The present invention relates to a device, in particular a stair lift, for conveying a person from a first level to a second level, comprising a rail which extends between the first and the second level, a frame which is provided with engaging means designed to engage the rail in such a manner that the frame can be moved along the rail, driving means designed to cause the frame to move along the rail, and a support, in particular a chair, on which the person can be seated, the stair lift furthermore being provided with control means designed to activate the driving means.

Stair lifts are intended for persons who are physically challenged, which persons often have difficulty in operating the control means. The object of the invention is to simplify their operation.

In order to achieve that object, the control means comprise at least one touch-sensitive surface, which surface extends or may extend in such a manner that a person can rest his or her hand, or a part thereof, on the surface so as to activate the driving means. This enables the persons to operate the stair lift in a simple manner, without using any force, and without having to engage or push any physical buttons.

The control means are preferably designed to activate the driving means, and to keep said driving means activated, if and as long as the hand, or a part thereof, rests on a predetermined part of the surface, and to deactivate the driving means when the hand, or a part thereof, is no longer in contact with said predetermined part of the surface. In this way the function of a dead man's button, which is present on the stair lift, becomes very user-friendly. The user can simply keep his hand or finger on a predetermined part of the surface so as to keep the chair moving.

The support is preferably a chair provided with at least one armrest, with the touch-sensitive surface in a preferred embodiment extending on the chair's armrest.

The touch-sensitive surface is preferably a touch-sensitive screen, wherein the control means are furthermore designed to display at least an instruction, an image of a control button and/or a message to the person on the screen. The touch-sensitive surface or screen may also be divided over two or more surfaces or screens. The image of a control button preferably indicates the aforesaid predetermined part of the surface.

The control means are preferably designed to activate the driving means when the hand, or a part thereof, makes a predetermined movement over the surface to the predetermined part of the surface, and to deactivate the driving means when the hand, or a part thereof, is no longer in contact with the predetermined part at the end of the movement being made. The control means are preferably designed to display an image of the control button on the screen, which image of the control button can be moved across the screen by the person by means of said predetermined movement.

The control means are furthermore preferably designed to receive a code by means of the control buttons being displayed on the touch-sensitive screen, and to compare said code with a code stored in the control means, such that the driving means can only be activated after it has been determined that the received code corresponds to the stored code. Preferably, several codes and several user names linked thereto are stored in the control means, wherein the control means are further designed to receive a user name by means of control buttons being displayed on the touch-sensitive screen, wherein the driving means can only be activated after it has been determined that the received code corresponds to the stored code that is linked to the received user name.

In a preferred embodiment, the touch-sensitive surface extends on a unit, for example a remote control unit, which is not fixed to the frame or which can be detached therefrom, wherein said unit and the frame comprise wired or wireless communication means for activating the driving means.

The invention will now be explained in more detail with reference to a preferred embodiment that is shown in the drawings, in which.

Figure 1:
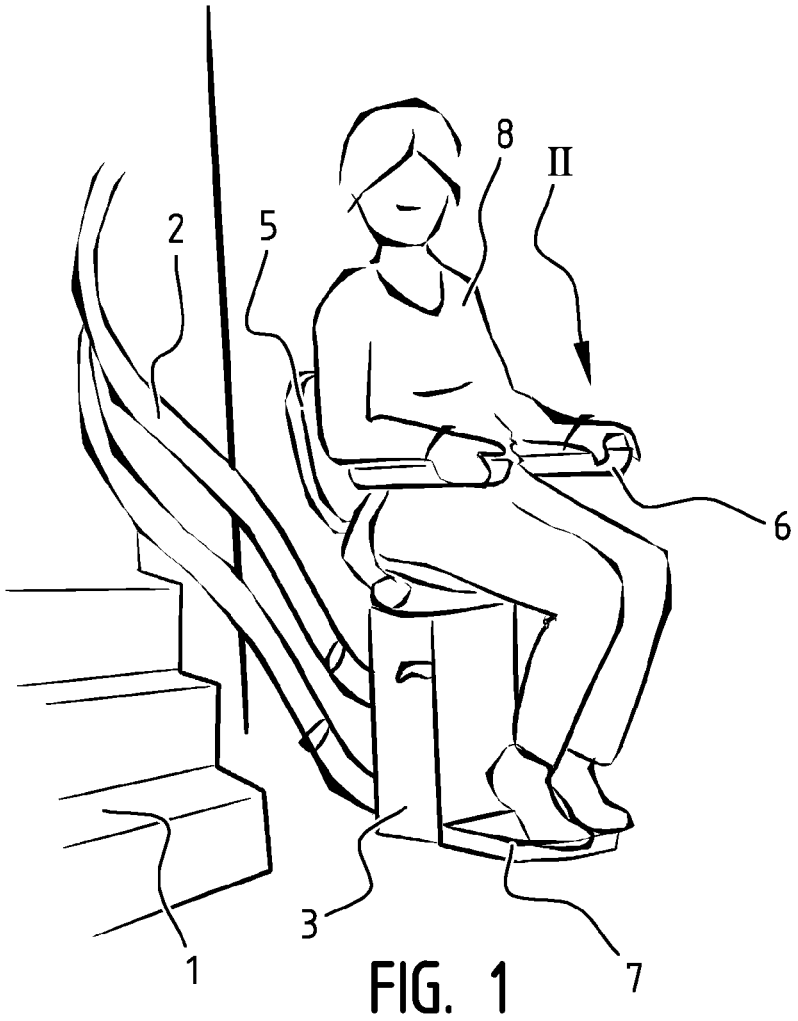
FIG. 1 is a schematic, perspective view of a stair lift according to the invention.

According to FIG. 1, a stair lift associated with a staircase 1 comprises a guide 2 along the staircase 1, and a frame 3 which can move along the guide 2 and which comprises a chair 5 provided with armrests 6 and a footrest 7, so that a person 8 can seat himself in the chair 5 so as to be conveyed along the staircase. The stair lift comprises control means for activating the driving means (comprising a motor and driving wheels that engage the guide) of the stair lift, i.e.: set the stair lift moving and cause it to move up or down, as desired, along the guide, and deactivating the driving means.

Figure 2:
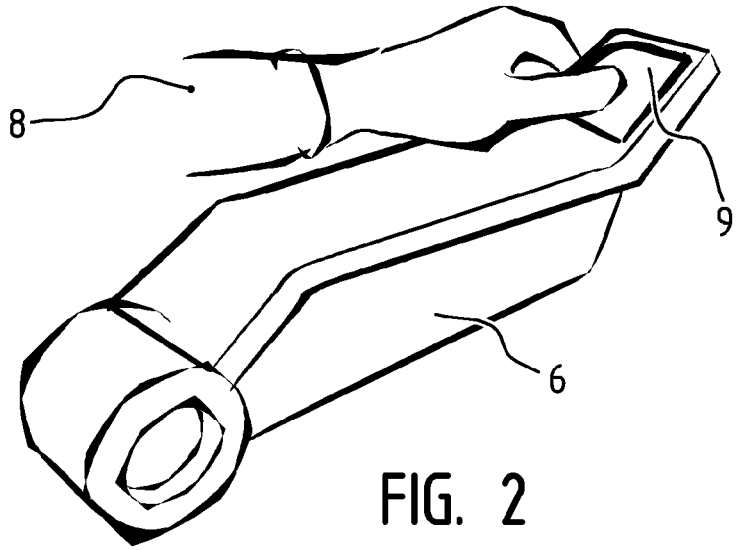
FIG. 2 is a schematic, perspective view of a detail of the stair lift of FIG. 1.

The control means comprise, inter alia, processor means loaded with suitable software, memory means and a touch-sensitive screen 9. As shown in FIG. 2, the screen 9 extends in the upper surface of an armrest 6, near the end thereof, so that the person 8 can operate the screen 9 in a simple and comfortable manner.

Figure 3:
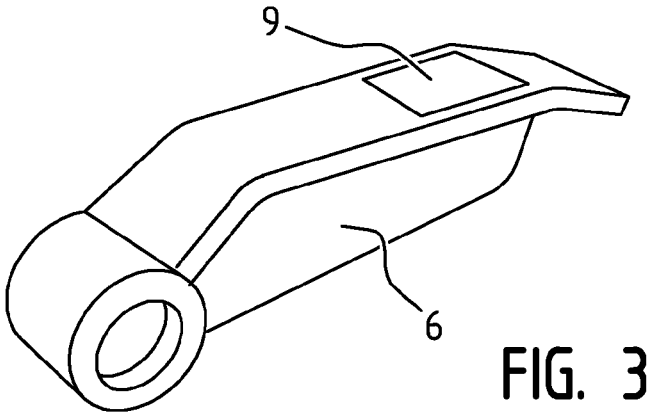
FIGS. 3-5 are perspective views of alternative embodiments of an armrest provided with a touch-sensitive screen for a stair lift according to the invention.
Figure 4:
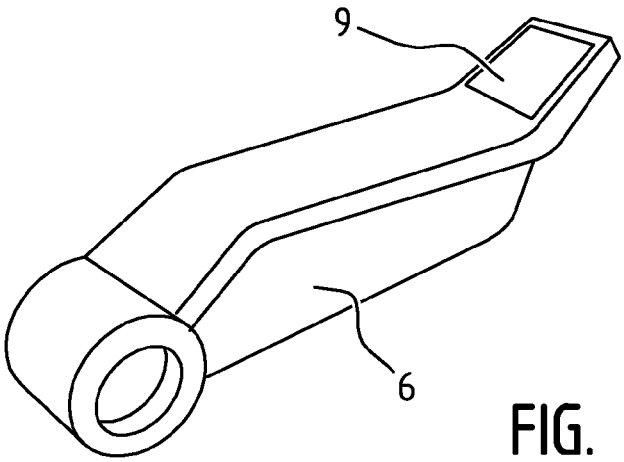
Figure 5:
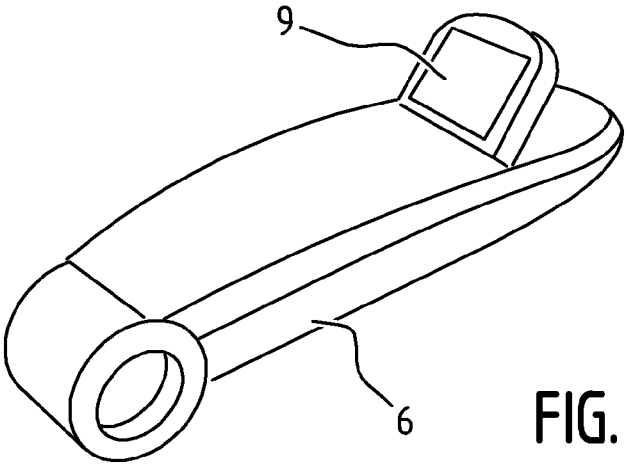

According to FIG. 3, the screen 9 extends substantially horizontally, so that the person 8 can easily put his hand and fingers on the screen. As shown in FIG. 4, the screen 9 extends at an angle, such that the person 8 can easily read the screen. As shown in FIG. 5, the screen 9 is pivotable, so that the person 8 himself can choose which position suits him best. The screen 9 may also be configured as a detachable screen, or be incorporated in a remote control unit, for example.

In FIGS. 6-14, a screen 9 displaying images of instructions 11, control buttons 12 and messages 13 is presented to the person 8.

Figure 6:
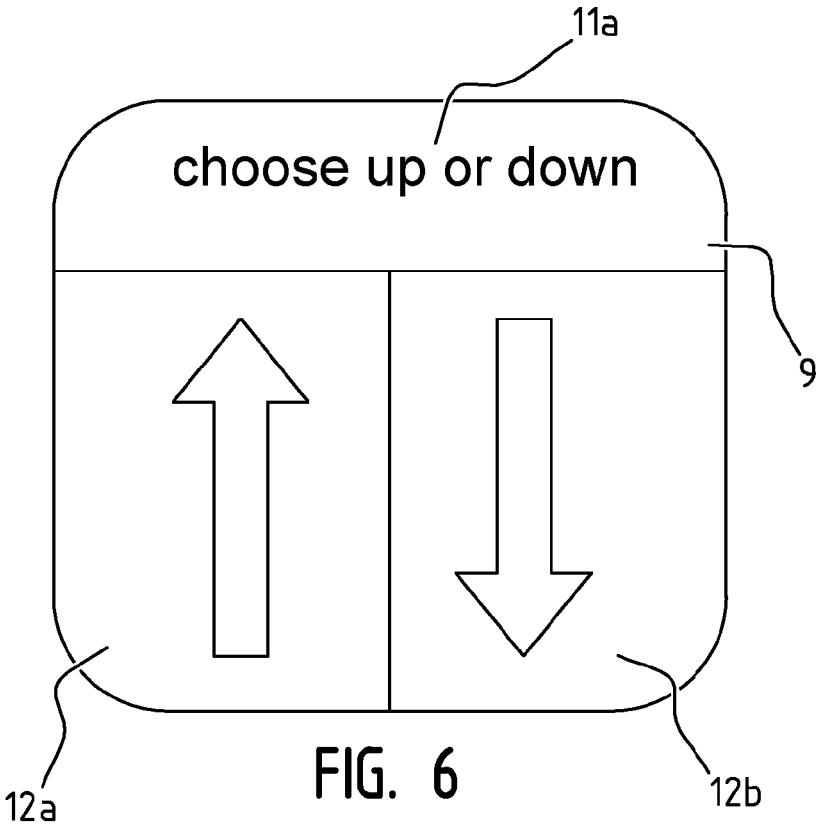
FIGS. 6-14 are screen views of the touch-sensitive screen according to the invention.
Figure 7:
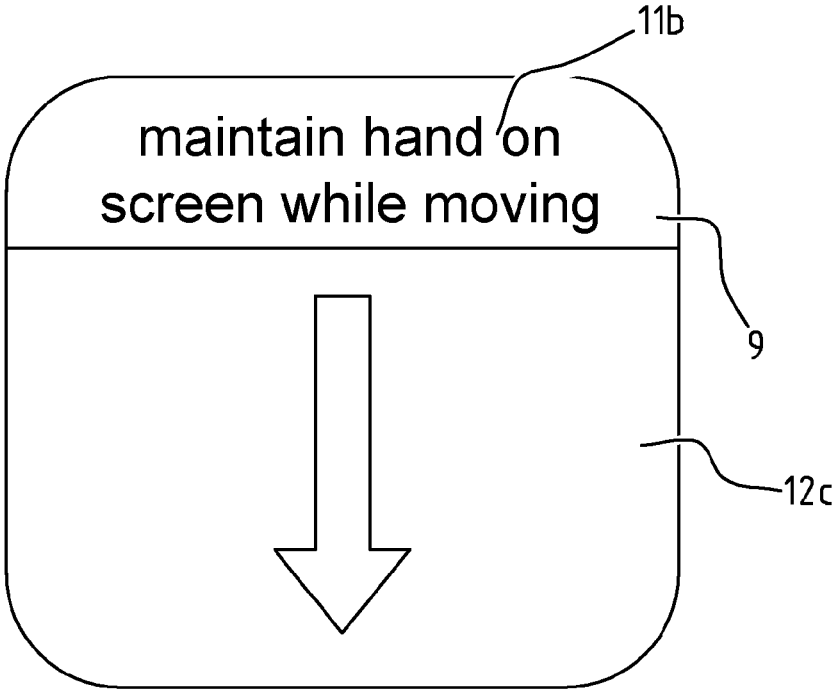

In FIG. 6, the person 8 is shown a screen 9 with an instruction 11*a*, in which the person 8 elects to have the frame 3 move up along the staircase 1 by touching the control button 12*a* and to have the frame 3 move down along the staircase 1 by touching the control button 12*b*. Subsequently, the person 8 is presented with a screen 9 on which a instruction 11*b* is displayed to keep a hand on the control button 12*c* so as to keep the frame 3 moving. As soon as the hand no longer makes contact with the screen 9, the frame 3 will stop.

Figure 8:
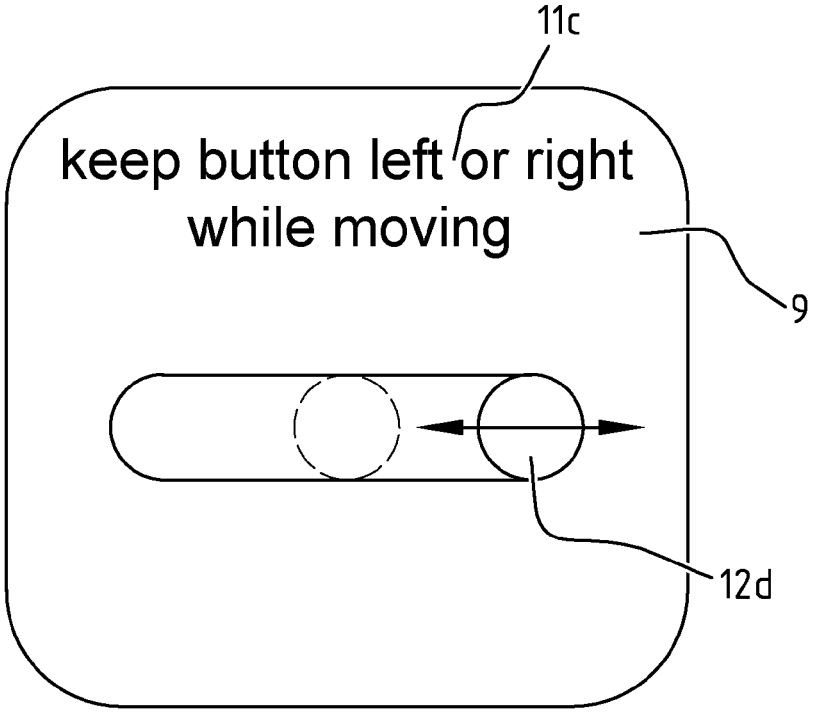

In an alternative variant shown in FIG. 8, the person 8 is shown a screen 9 displaying an instruction 11*c* to move the control button 12*d* to the left or to the right and to keep the control button 12 in that position while the frame is moving along the staircase. As soon as the control button 12*d* is released, the frame 3 will stop and the control button 12*d* will return to the centre of the screen. The person 8 may also continue to hold the button 12*d* but move it to the centre of the screen, so that the frame 3 will stop.

Figure 9:
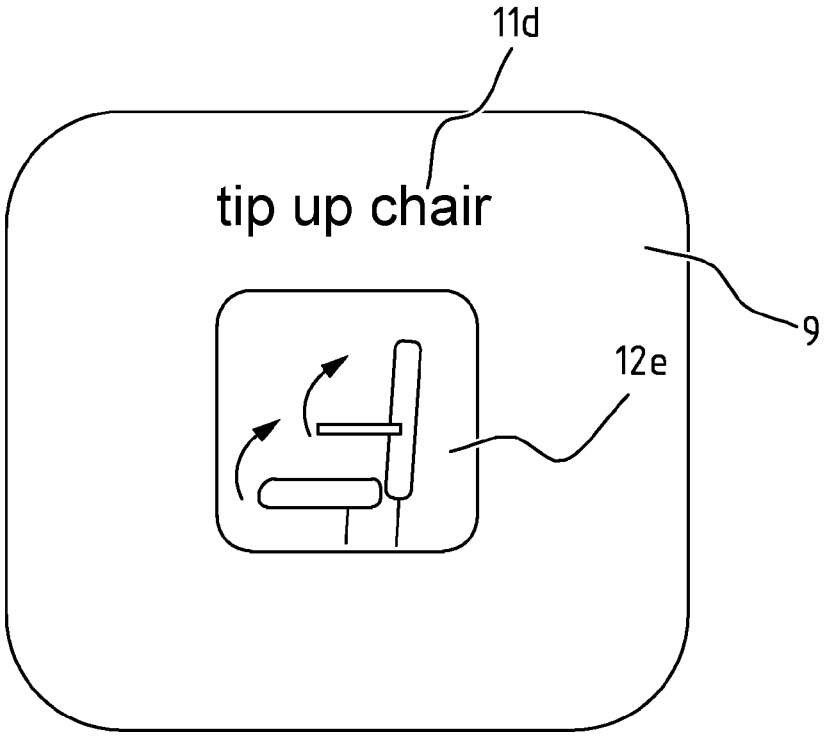

FIG. 9 shows a screen 9 that displays an instruction 11*d* to tip up the chair. This instruction will be carried out when a person touches the control button 12*e*.

Figure 10:
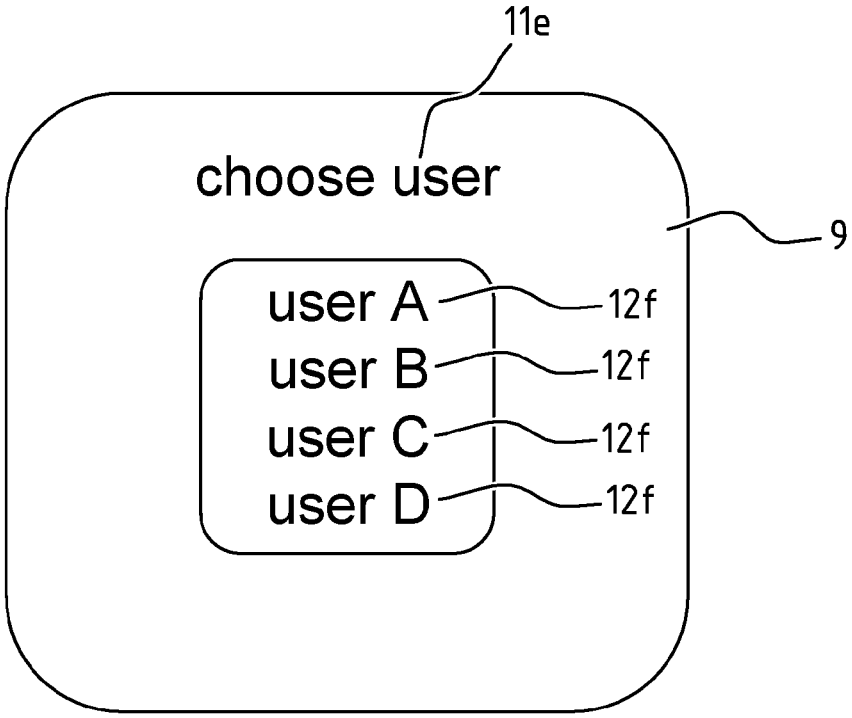
Figure 11:
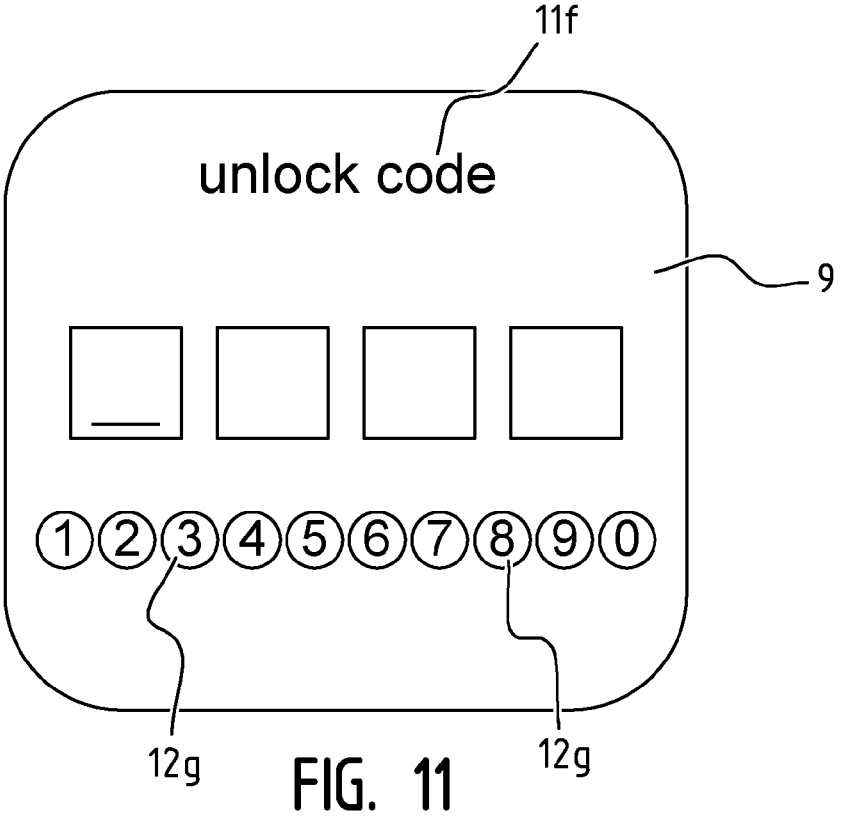

FIG. 10 shows a screen 9 that displays an instruction 11*e* to select a user name from a list of control buttons 12*f* with user names. By touching the correct control button 12*f* the person 8 selects his own user name and is subsequently shown a screen according to FIG. 11 with the instruction 11*f* to enter an unlock code. By touching the correct control buttons 12*g*, the person 8 can enter the correct code that is stored in the memory. If the code has been correctly entered, the drive of the drive means will be unlocked.

Figure 12:
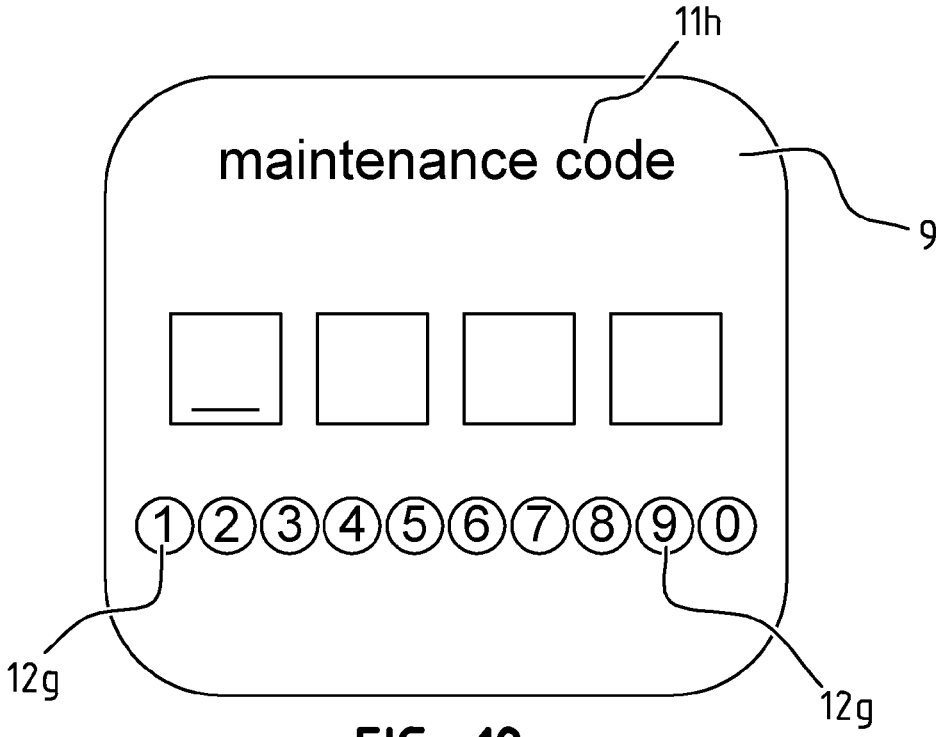

FIG. 12 shows a screen 9 with an instruction 11*i* to enter a maintenance code, in which screen a technician wishing to carry out maintenance can enter a code by means of control buttons 12*g*. After the correct code has been entered, the maintenance menu will be displayed.

Figure 13:
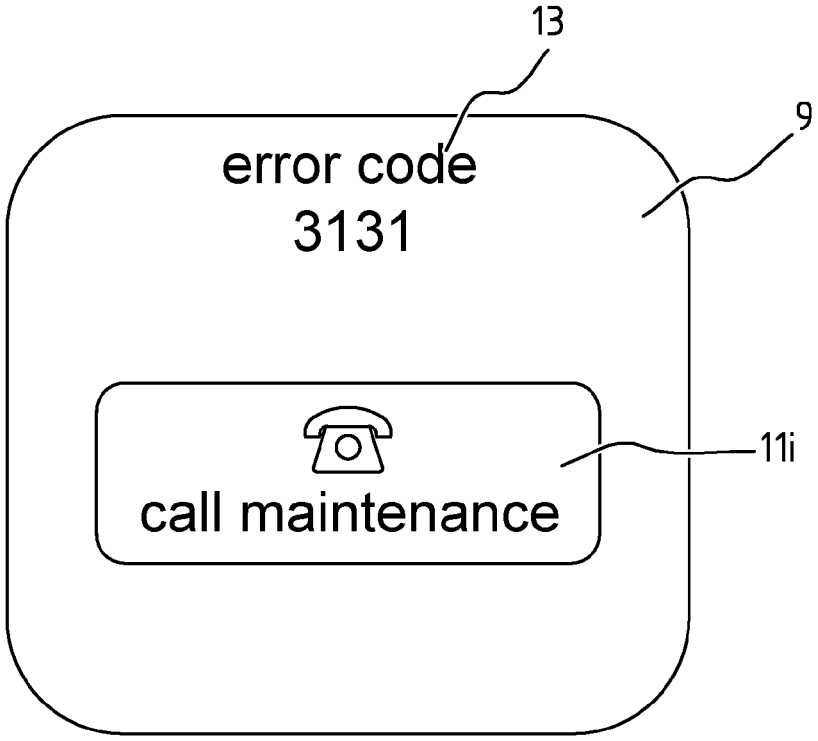

FIG. 13 shows a screen 9 with a message 13, and the associated error code, informing the user of a malfunction, and with the instruction 11*i* to call a maintenance number.

Figure 14:
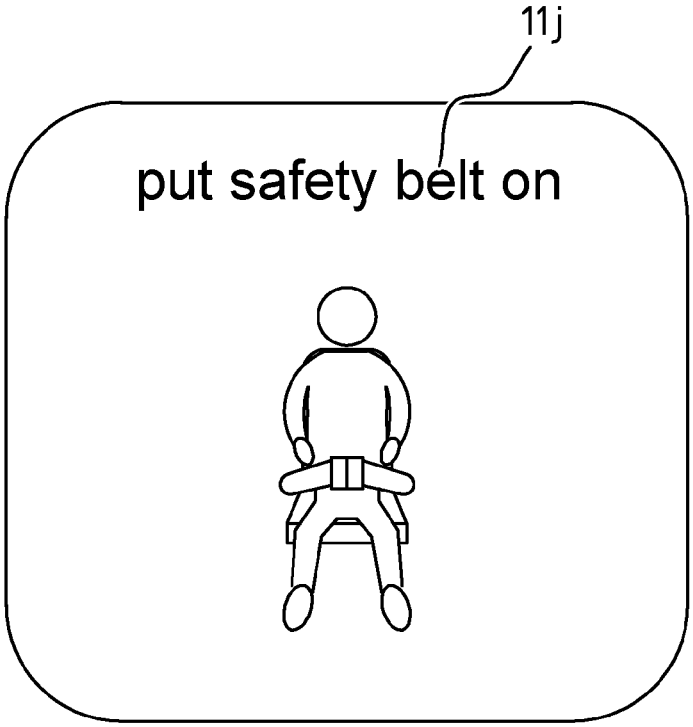

FIG. 14 shows the screen 9 with an instruction 11*j* to put on a safety belt.

The various screen displays as shown on the screen 9 in FIGS. 6-14 can be accessed in a known manner by means of menus.

Whilst the foregoing presents a full description of the preferred embodiments of the present invention, various modifications, alternative constructions and equivalents are possible without departing from the true spirit and the scope of the invention. Consequently, the above description and the illustrations must not be construed as being limitative to the scope of the invention.

The invention claimed is:

1. A device, for conveying a person from a first level to a second level, comprising:

a rail which extends between the first and the second level;

a frame which is provided with engaging means designed to engage the rail in such a manner that the frame can be moved along the rail;

driving means designed to cause the frame to move along the rail;

a support, on which the person can be seated;

control means designed to activate the driving means, wherein the control means comprise at least one touch-sensitive surface sensitive to a contact point made by the person upon touching the touch-sensitive surface, said control means being able to determine a location of the contact point on said touch sensitive surface, which surface extends or can be arranged to extend such that a person can rest his or her hand, or a part thereof, on the surface, wherein a portion of the said touch-sensitive surface is designated as a predetermined part of the surface, wherein the control means are configured to activate the driving means and cause the frame to move along the rail when the control means determine when the hand of the person, or a part thereof, makes a specified movement on the touch-sensitive surface, wherein the specified movement is a movement made by the hand of the person, or a part thereof, to move an image displayed on the touch-sensitive surface, and wherein the control means are configured to activate the driving means and cause the frame to move along the rail as long as the hand, or a part thereof, maintains contact on the predetermined part of the surface and to deactivate the driving means when the control means determine that the hand, or a part thereof, is no longer in contact with the predetermined part of the surface.

2. A device according to claim 1, wherein the touch-sensitive surface is a touch-sensitive screen, wherein the control means are furthermore designed to display at least an instruction, an image of a control button and/or a message on the screen.

3. A device according to claim 2, wherein the control means are designed to display an image of a control button on the screen, which image can be moved across the screen according to the specified movement made by the person on the touch-sensitive surface.

4. A device according to claim 2, wherein the control means are furthermore designed to receive a code by means of buttons being displayed on the touch-sensitive screen, and to compare said code with a code stored in the control means, such that the driving means can only be activated to cause the frame to move along the rail after it has been determined that the received code corresponds to the stored code.

5. A device according to claim 1, wherein the support is a chair provided with at least one armrest, and wherein the touch-sensitive surface extends on said at least one armrest.

6. A device according to claim 1, wherein the touch-sensitive surface extends on a unit, which can be detached from the frame, wherein said unit and the frame comprise wired or wireless communication means for activating the driving means.

7. A device according to claim 1, wherein the device is a stair lift.

8. A device according to claim 1, wherein the support is a chair.

* * * * *